US011713674B2

(12) United States Patent
Chen et al.

(10) Patent No.: US 11,713,674 B2
(45) Date of Patent: Aug. 1, 2023

(54) PRESSURE PULSE COMMUNICATION SYSTEM AND METHOD DURING GAS DRILLING

(71) Applicants: Southwest Petroleum University, Chengdu (CN); Haohan Well Completion & Logging Science and Technology Limited Company, Chengdu (CN)

(72) Inventors: Xingyu Chen, Chengdu (CN); Yingfeng Meng, Chengdu (CN); Gao Li, Chengdu (CN); Yijian Chen, Chengdu (CN); Hongtao Li, Chengdu (CN); Lunping Zhang, Chengdu (CN); Kejing Wang, Chengdu (CN)

(73) Assignees: Southwest Petroleum University, Chengdu (CN); Haohan Well Completion & Logging Science and Technology Limited Company, Chengdu (CN)

( * ) Notice: Subject to any disclaimer, the term of this patent is extended or adjusted under 35 U.S.C. 154(b) by 0 days.

(21) Appl. No.: 17/952,351

(22) Filed: Sep. 26, 2022

(65) Prior Publication Data

US 2023/0095056 A1 Mar. 30, 2023

(30) Foreign Application Priority Data

Sep. 28, 2021 (CN) ..... 202111146258.9

(51) Int. Cl.
*E21B 47/18* (2012.01)
*E21B 34/06* (2006.01)

(52) U.S. Cl.
CPC ..... *E21B 47/18* (2013.01); *E21B 34/066* (2013.01)

(58) Field of Classification Search
CPC ..... E21B 28/00; E21B 34/066; E21B 47/14; E21B 47/18; E21B 47/20; E21B 47/22; E21B 47/24
See application file for complete search history.

(56) References Cited

U.S. PATENT DOCUMENTS 4,386,422 A * 5/1983 Mumby ..... E21B 47/22 367/83
4,733,233 A 3/1988 Grosso et al.
(Continued)

FOREIGN PATENT DOCUMENTS

CN 101660407 A 3/2010
CN 101737009 A 6/2010
(Continued)

*Primary Examiner* — Jennifer H Gay
(74) *Attorney, Agent, or Firm* — Bayramoglu Law Offices LLC

(57) ABSTRACT

A pressure pulse communication system and method during gas drilling are provided. The system includes a downhole solenoid valve module and a sensor module, where the downhole solenoid valve module includes a valve body, a gas inlet, a piston micro-hole, a moving piston, a piston return spring, a piston cylinder, a gas outlet, a piston pressure relief hole, a solenoid valve spring, a solenoid valve, a battery, a pressure balancer, and a rubber seal. The pressure pulse communication system and method generate pressure pulses by changing the internal pressure of a drill pipe, such that a surface pressure sensor continuously receives the pressure pulses, thereby achieving the purpose of acquiring downhole temperature, pressure, and well inclination angle data.

6 Claims, 5 Drawing Sheets

(56) References Cited

U.S. PATENT DOCUMENTS

| | | | | |
|---|---|---|---|---|
| 6,019,182 | A * | 2/2000 | Rountree | E21B 44/005 166/117.6 |
| 9,879,528 | B2 * | 1/2018 | Pratt | E21B 47/24 |
| 11,098,580 | B2 * | 8/2021 | Segura | E21B 47/18 |
| 11,525,355 | B2 * | 12/2022 | Segura | E21B 21/10 |
| 2007/0056771 | A1 | 3/2007 | Gopalan et al. | |
| 2014/0262525 | A1 * | 9/2014 | Fuller | E21B 7/128 175/57 |
| 2021/0040843 | A1 * | 2/2021 | Segura | E21B 21/10 |
| 2021/0381371 | A1 * | 12/2021 | Segura | E21B 47/18 |

FOREIGN PATENT DOCUMENTS

| | | | |
|---|---|---|---|
| CN | 102425411 | A | 4/2012 |
| CN | 104334831 | A | 2/2015 |
| CN | 108316920 | A | 7/2018 |
| CN | 110397419 | A | 11/2019 |
| CN | 111566313 | A | 8/2020 |
| CN | 112639250 | A | 4/2021 |

* cited by examiner

PRESSURE PULSE COMMUNICATION SYSTEM AND METHOD DURING GAS DRILLING

CROSS REFERENCE TO THE RELATED APPLICATION

The present application is based upon and claims priority to Chinese Patent Application No. 202111146258.9, filed on Sep. 28, 2021, the entire content of which is hereby incorporated by reference.

TECHNICAL HELD

The present disclosure belongs to the field of petroleum exploration and development, and in particular, relates to a pressure pulse communication system and method during gas drilling.

BACKGROUND

Gas drilling has substantially increased the rate of penetration (ROP), but its development is limited due to wellbore control and other issues. Among them, data transmission is a key issue in the measurement-while-drilling (MWD) of directional and horizontal wells.

Due to the lack of drilling fluid circulation, the theoretically and technically perfect mud pulse (MP) telemetry cannot be used in the drilling process.

Low-frequency electromagnetic (LF-EM) telemetry is susceptible to stratigraphic formation characteristics. In low-resistivity stratigraphic formations, only data transmission at specific depths can be completed with large signal attenuations.

The acoustic data transmission technology uses the inner hole of the drill string as the channel and provides the signal source through vibration and other methods downhole. However, the acoustic signal is easily interfered with by other excitation sources, such as tool vibration and friction during the transmission process, and it is difficult to decode after transmission to the surface. In addition, due to the disturbance of the multiphase flow regime, the acoustic transmission distance is limited. In particular, due to the lack of sufficient drilling fluid for buffering, the vibration of the drilling tool will be more intense, causing even greater interference to the acoustic signal.

In microwave-based measurement-while-drilling (M-MWD) technology, an MWD sub is provided near the drill bit to acquire data. The drill pipe is used as a microwave waveguide, and signal relays are added inside the drill pipe to transmit downhole measurement data to the surface for processing. However, the drill pipe greatly affects the signal, which will be significantly attenuated if the drill pipe is rusted.

SUMMARY

To overcome the above-mentioned deficiencies in the prior art, the present disclosure provides a pressure pulse communication system and method during gas drilling, which solves the problem of limited transmission distance of traditional air drilling communication.

To achieve the above objective of the present disclosure, the present disclosure adopts the following technical solution: A pressure pulse communication system during gas drilling is provided. The system includes a downhole solenoid valve module and a sensor module, where the downhole solenoid valve module and the sensor module are arranged in a drill pipe of a surface drill rig. The sensor module is connected to a solenoid valve of the downhole solenoid valve module. The downhole solenoid valve module includes a valve body, a gas inlet, a piston micro-hole, a moving piston, a piston return spring, a piston cylinder, a gas outlet, a piston pressure relief hole, a solenoid valve spring, the solenoid valve, a battery, a pressure balancer, a rubber seal, a first gas passage, a second gas passage, and a gas passage in the valve body.

The piston return spring has one end fixed to the upper half of the inner wall of the valve body and the other end connected to the moving piston. The piston micro-hole is provided between the upper end surface of the moving piston and the inner wall surface of the valve body. The valve body is further provided therein with the piston cylinder for accommodating the piston return spring and the moving piston. The gas inlet is connected to the piston cylinder through the piston micro-hole; the gas outlet is provided between the side of the moving piston that is not connected to the piston return spring and the inner wall of the valve body. When the piston return spring is in a compressed state, the gas outlet communicates with the gas inlet. When the piston return spring is in a reset state, the gas outlet and the gas inlet are isolated by the inner wall of the valve body, and the gas outlet communicates with the gas passage in the valve body.

The solenoid valve is provided on the lower half of the inner wall of the valve body. The solenoid valve spring is provided on top of the solenoid valve. A space in which the solenoid valve spring is provided is connected to the piston cylinder through the first gas passage on the left and is connected to the piston pressure relief hole through the second gas passage on the right. The piston pressure relief hole communicates with the gas passage in the valve body. The battery is provided below the solenoid valve and is electrically connected to the solenoid valve. The pressure balancer is provided on the inner wall of the valve body below the battery, and the rubber seal is provided at a connection between the valve body and the drill pipe.

Further, the sensor module may include a pressure sensor, a sensor chip set, a data storage, and a logic coding controller. The pressure sensor may be provided on the inner wall of the valve body on two sides of the solenoid valve and may be connected in communication with the logic coding controller. The sensor chip set, the data storage, and the logic coding controller may be provided on the lower half of the inner wall of the valve body. The logic coding controller may be connected in communication with the sensor chip set and the data storage.

The solution has additional beneficial effects. The downhole data is acquired by the sensor module, and the high-pressure and low-pressure pulses are controlled and excited to realize information communication.

A pressure pulse communication method during gas drilling includes the following steps:

S1: acquiring, by a pressure sensor and a sensor chip set, pressure, temperature, and well inclination data when a surface drill rig is drilling normally; and generating downhole data through logic coding, and storing the downhole data in a data storage;

S2: setting a pressure threshold according to downhole data to be transmitted by a logic coding controller;

S3: if transmission of the downhole data is needed, controlling the surface drill rig to stop drilling without interrupting a gas circulation; and recording, by the pressure sensor, a current pressure value as an initial pressure value $P_0$;

S4: closing, by a moving piston, a gas outlet to increase the pressure in the piston cylinder when the pressure sensor detects that pressure in a piston cylinder reaches the initial pressure value $P_0$;

S5: opening, by the moving piston, the gas outlet to reduce the pressure in the piston cylinder to the initial pressure value $P_0$ when the pressure sensor detects that the pressure in the piston cylinder reaches the pressure threshold; and obtaining a low-pressure pulse or a high-pressure pulse according to the pressure threshold;

S6: recording, by a surface pressure sensor, the low-pressure pulse or the high-pressure pulse, which are corresponding to "0" or "1" in a binary code of the downhole data, respectively; and S7: repeating steps S2 to S6 according to the downhole data to be transmitted by the logic coding controller, and completing the pressure pulse communication while drilling based on the downhole data characterized by the high-pressure pulse or low-pressure pulse recorded by the surface pressure sensor.

Further, in step S1, the step of generating downhole data through logic coding may specifically include:

generating, by the logic coding controller, the binary downhole data through logic coding.

The solution has further beneficial effects. The sensor chip set acquires the downhole data and generates high-pressure and low-pressure pulses according to the downhole data to complete the communication of the downhole data.

Further, in step S2, the step of setting a pressure threshold may specifically include:

Setting the pressure threshold according to the downhole data to be transmitted by the logic coding controller, setting the pressure threshold to $P_1$ if the data to be transmitted by the logic coding controller is "0" in the binary code, and setting the pressure threshold to $P_2$ if the data to be transmitted by the logic coding controller is "1" in the binary code.

The solution has further beneficial effects. The transmission of the binary downhole data is realized according to the high-pressure and low-pressure pulses, and the communication method is simple and not limited by distance.

Further, step S4 may specifically include:

S41: opening, by the logic coding controller, a solenoid valve when the pressure sensor detects that the current pressure value reaches the initial pressure value $P_0$, such that the solenoid valve moves against an elastic force of a solenoid valve spring to seal a piston pressure relief hole; and S42: guiding a gas injected from a gas inlet to the piston cylinder through a piston micro-hole; and moving, by the piston return spring, the moving piston to close the gas outlet to increase the pressure in the piston cylinder.

The solution has the following beneficial effects. The gas outlet is closed by the moving piston, such that the pressure in the piston cylinder is increased to release high-pressure and low-pressure pulses.

Further, step S5 may specifically include:

S51: closing, by the logic coding controller, the solenoid valve when the pressure sensor detects that the pressure in the piston cylinder reaches the pressure threshold; and resetting the solenoid valve spring to move the solenoid valve to open the piston pressure relief hole; and S52: discharging the gas in the piston cylinder from the piston pressure relief hole to reduce the pressure in the piston cylinder and moving the moving piston to open the gas outlet, such that the pressure in the piston cylinder is reduced to the initial pressure value $P_0$, and a low-pressure pulse or the high-pressure pulse is Obtained, where:

When the pressure threshold is a low-pulse pressure value, namely $P_1$, the low-pressure pulse is obtained; and when the pressure threshold is a high-pulse pressure value, namely $P_2$, the high-pressure pulse is obtained.

The solution has further beneficial effects. By setting the pressure threshold, the piston cylinder is adjusted to release the low-pressure pulse or high-pressure pulse to complete the transmission of the downhole data.

The present disclosure has the following beneficial effects:

(1) In the present disclosure, the solenoid valve control system has a simple structure and low cost.

(2) In the present disclosure, the communication data is not limited by the transmission distance, and a longer transmission distance only requires a longer time to transmit the signal.

(3) Compared with the microwave-based measurement-while-drilling (M-MWD) technology that requires the inside of the drill pipe to be dry and free of foreign matter, the technology of the present disclosure can be used for mist drilling or foam drilling. Compared with mud pulse (MP) telemetry that cannot be used for gas drilling, the technology of the present disclosure can be used for air drilling and even aerated mud drilling.

REFERENCE NUMERALS

1. valve body; 2. gas inlet; 3. piston micro-hole; 4. moving piston; 5. piston return spring; 6. piston cylinder; 7. gas outlet; 8. piston pressure relief hole; 9. pressure sensor; 10. solenoid valve spring; 11. solenoid valve; 12. battery; 13. pressure balancer; 14. sensor chip set; 15. rubber seal; 16. data storage; 17. logic coding controller; 18. first gas passage; 19. second gas passage; and 20. gas passage in valve body.

DETAILED DESCRIPTION OF THE EMBODIMENTS

The specific implementations of the present disclosure are described below to facilitate those skilled in the art to understand the present disclosure, but it should be clear that the present disclosure is not limited to the scope of the specific implementations. Various obvious changes made by those of ordinary skill in the art within the spirit and scope of the present disclosure defined by the appended claims should fall within the protection scope of the present disclosure.

Figure 1:
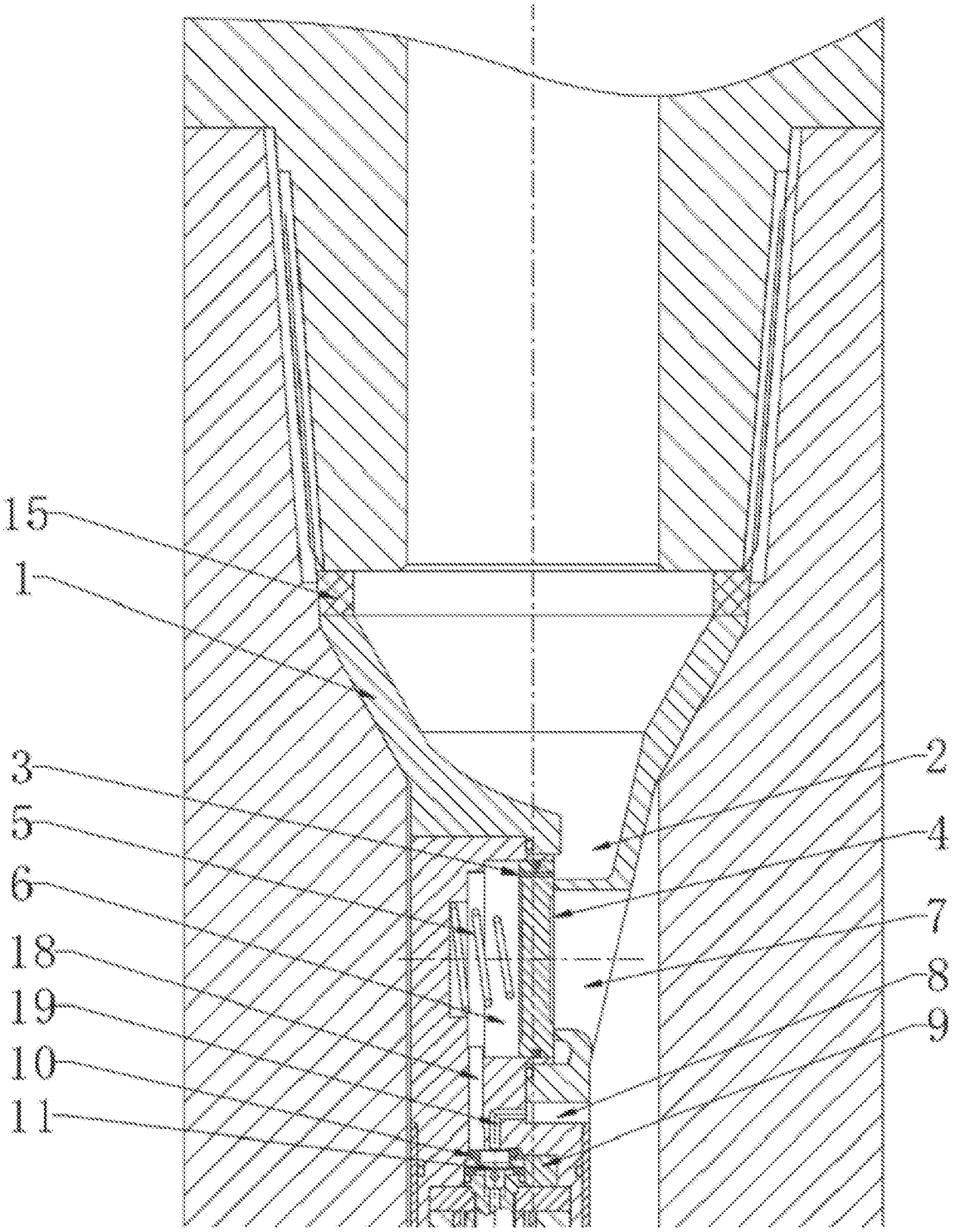
FIG. 1 is a structural diagram of the upper half of a pressure pulse communication system during gas drilling according to the present disclosure.

As shown in FIG. 1, an embodiment of the present disclosure provides a pressure pulse communication system during gas drilling. The system includes a downhole solenoid valve module and a sensor module. The downhole solenoid valve module and the sensor module are arranged in a drill pipe of a surface drill rig. The sensor module is connected to a solenoid valve 11 of the downhole solenoid valve module. The downhole solenoid valve module includes a valve body 1, a gas inlet 2, a piston micro-hole 3, a moving piston 4, a piston return spring 5, a piston cylinder 6, a gas outlet 7, a piston pressure relief hole 8, a solenoid valve spring 10, the solenoid valve 11, a battery 12, a pressure balancer 13, a rubber seal 15, a first gas passage 18, a second gas passage 19, and a gas passage 20 in the valve body.

The piston return spring 5 has one end fixed to the upper half of the inner wall of the valve body 1 and the other end connected to the moving piston 4. The piston micro-hole 3 is provided between an upper end surface of the moving piston 4 and an inner wall surface of the valve body 1. The valve body 1 is further provided therein with the piston cylinder 6 for accommodating the piston return spring 5 and the moving piston 4. The gas inlet 2 is connected to the piston cylinder 6 through the piston micro-hole 3. The gas outlet 7 is provided between the side of the moving piston 4 that is not connected to the piston return spring 5 and the inner wall of the valve body 1. When the piston return spring 5 is in a compressed state, the gas outlet 7 communicates with the gas inlet 2. When the piston return spring 5 is in a reset state, the gas outlet 7 and the gas inlet 2 are isolated by the inner wall of the valve body 1 and the gas outlet 7 communicates with the gas passage 20 in the valve body.

Figure 2:
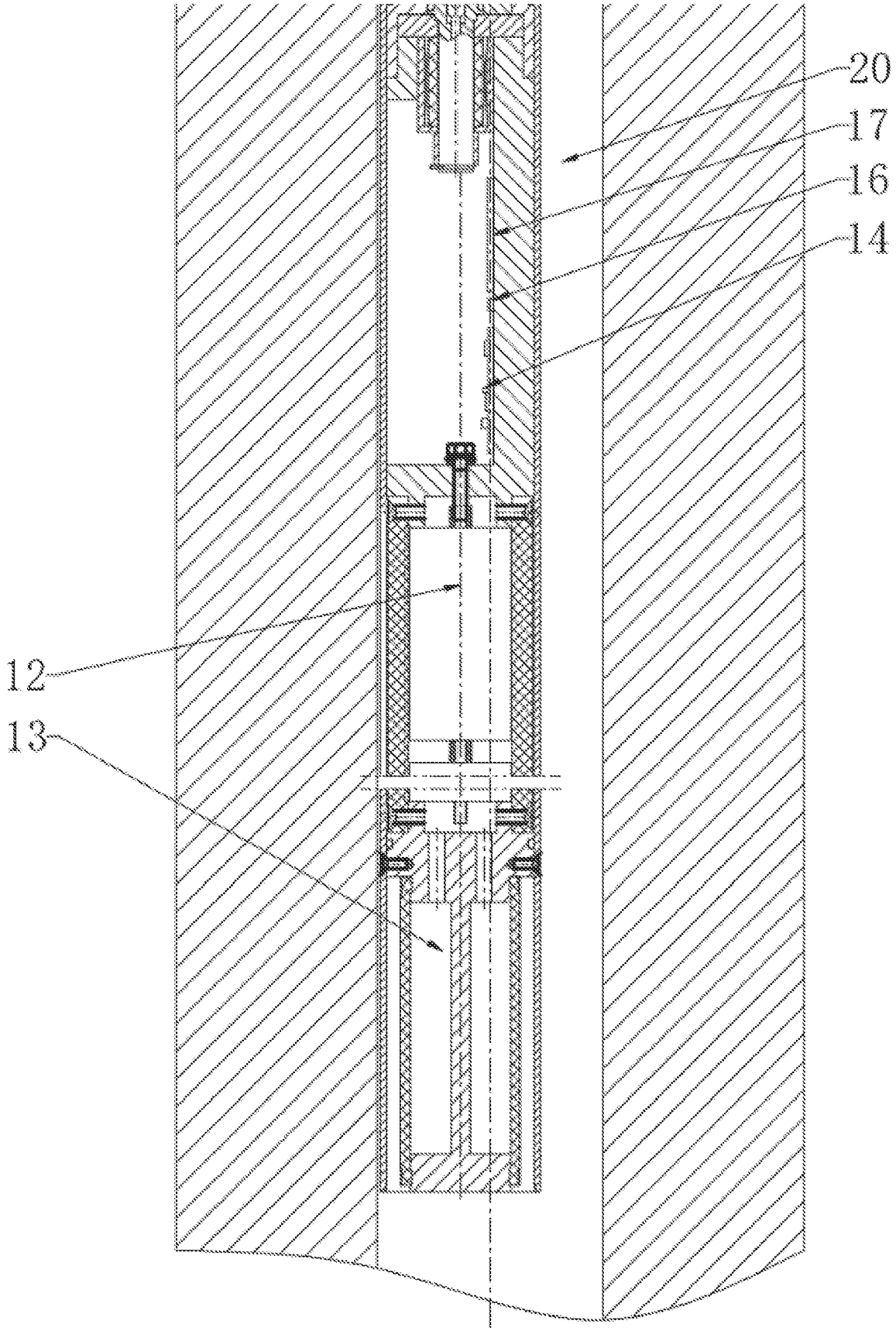
FIG. 2 is a structural diagram of the lower half of the pressure pulse communication system during gas drilling according to the present disclosure.

As shown in FIG. 2, the solenoid valve 11 is provided on the lower half of the inner wall of the valve body 1. The solenoid valve spring 10 is provided on the top of the solenoid valve 11. A space in which the solenoid valve spring 10 is provided is connected to the piston cylinder 6 through the first gas passage 18 on the loft and is connected to the piston pressure relief hole 8 through the second gas passage 19 on the right. The piston pressure relief hole 8 communicates with the gas passage 20 in the valve body. The battery 12 is provided below the solenoid valve 11 and is electrically connected to the solenoid valve 11. The pressure balancer 13 is provided on the inner wall of the valve body 1 below the battery 12. The rubber seal 15 is provided at a connection between the valve body 1 and the drill pipe.

In this embodiment, the model of the solenoid valve 11 is 2KW03008B, and the model of battery 12 is LR54.

The gas inlet 2 is configured to inject gas. The piston micro-hole 3 is configured to connect the gas inlet 2 for the piston cylinder 6. The moving piston 4 is configured to open or close the gas outlet 7. The piston return spring 5 is configured to reset the moving piston 4. The piston cylinder 6 is configured to store the gas to increase pressure. The gas outlet 7 is configured to maintain a normal circulation of a gas flow channel. The piston pressure relief hole 8 is configured to release a high-pressure gas. The solenoid valve spring 10 is configured to reset the solenoid valve 11. The solenoid valve 11 is configured to close the piston pressure relief hole 8. The battery 12 is configured to provide electrical power to the system. The pressure balancer 13 is configured to balance the pressure inside an instrument and the pressure inside the drill pipe. The rubber seal 15 is configured to secure the entire instrument.

The sensor module includes a pressure sensor 9, a sensor chip set 14, a data storage 16, and a logic coding controller 17. In this embodiment, the model of the pressure sensor 9 is MDM290. The pressure sensor 9 is provided on the inner wall of the valve body 1 on two sides of the solenoid valve 11 and is connected in communication with the logic coding controller 17. The sensor chip set 14, the data storage 16, and the logic coding controller 17 are provided on the lower half of the inner wall of the valve body 1. The logic coding controller 17 is connected in communication with the sensor chip set 14 and the data storage 16. In this embodiment, the model of the sensor chip set 14 is MU AHRS 10DOF, the model of the data storage 16 is YJKJ18-504, and the model of the logic coding controller 17 is C8051F340-GQR.

The sensor chip set 14 acquires temperature and well inclination data through an internal temperature sensor and well inclination sensor. An angular velocity sensor inside the sensor chip set 14 detects a stop action of the surface drill rig by sensing an angular velocity change.

The logic coding controller 17 is configured to perform binary coding on the acquired downhole data and store the binary data in the data storage 16. The logic coding controller 17 further sets a pressure threshold based on the downhole data. During downhole data transmission, when a pressure value detected by the pressure sensor 9 reaches the pressure threshold, the solenoid valve 11 is controlled to be powered off. When the pressure value detected by the pressure sensor 9 is equal to an initial pressure value $P_0$, the solenoid valve 11 is controlled to be powered on.

In the present disclosure, the working state of the downhole solenoid valve module includes an initial state and a ventilation state. Specifically:

Initial state: The piston return spring 5 acts on the moving piston 4 to close the gas outlet 7, the solenoid valve 11 is powered off, and the solenoid valve spring 10 is reset to open the piston pressure relief hole 8.

Figure 3:
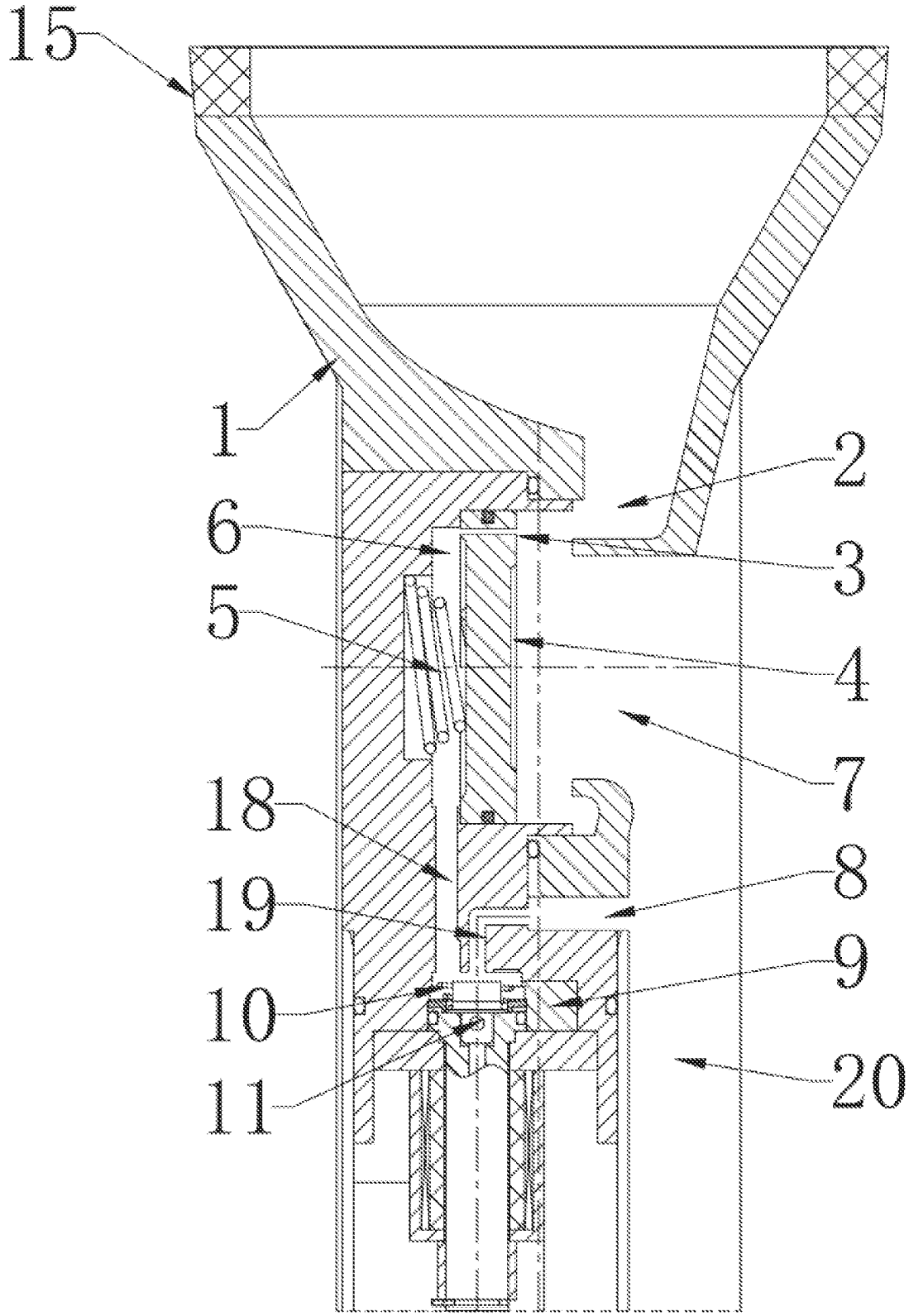
FIG. 3 is a structural diagram of the upper half of the pressure pulse communication system during gas drilling according to the present disclosure, where a solenoid valve is opened.

Ventilation state: As shown in FIG. 3, the gas inlet 2 continues to inject the gas. The gas passes through the gas inlet 2, the piston micro-hole 3, the piston cylinder 6, and the piston pressure relief hole 8 to form the gas flow channel. Continuous ventilation causes the pressure on the left of the moving piston 4 to be greater than the pressure on the right. The moving piston 4 moves against an elastic force of the piston return spring 5 and opens the gas outlet 7, such that the gas flow channel constitutes a normal circulation.

Figure 4:
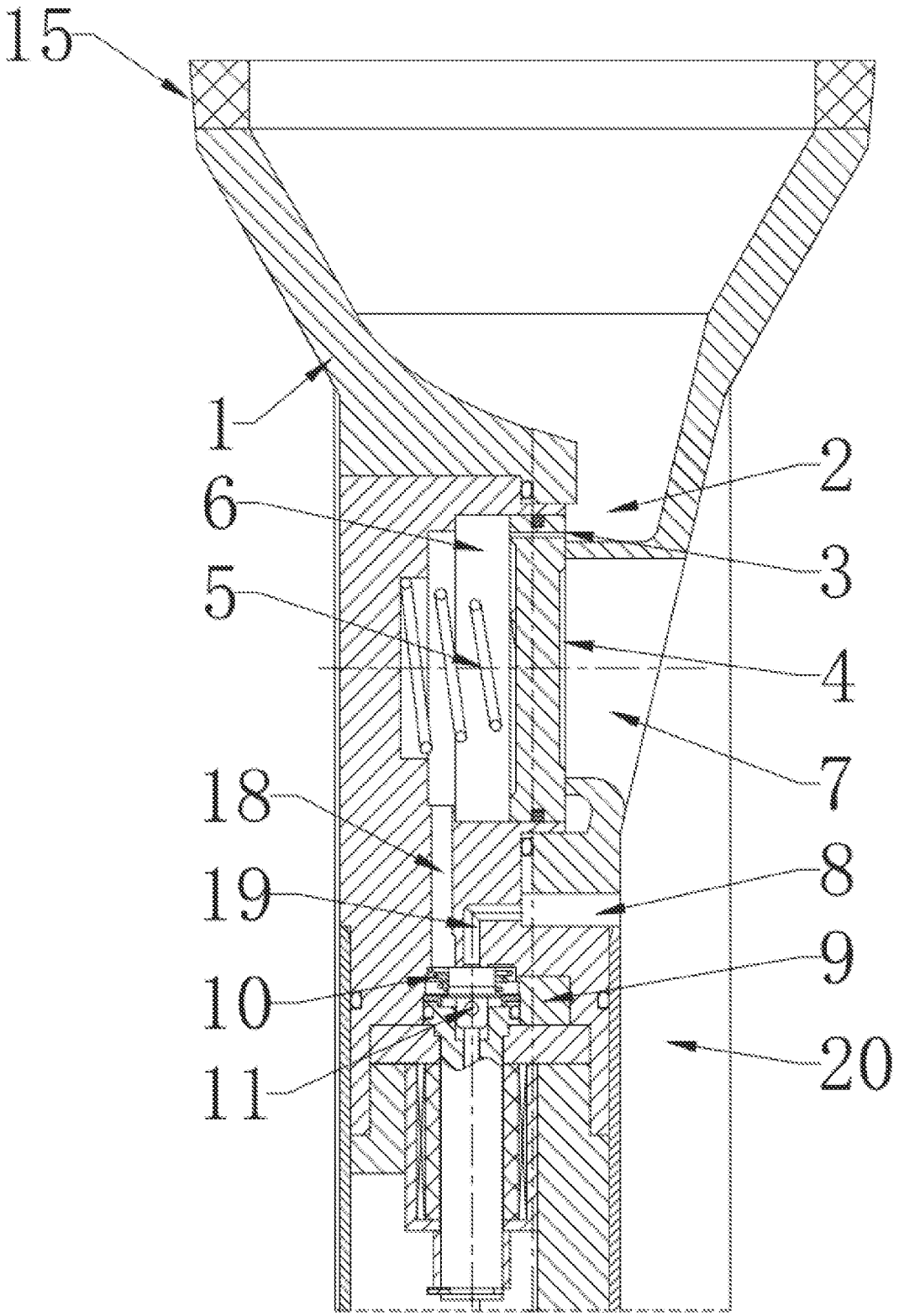
FIG. 4 is a structural diagram of the upper half of the pressure pulse communication system during gas drilling according to the present disclosure, where the solenoid valve is closed.

As shown in FIG. 4, when the solenoid valve 11 is powered on, the solenoid valve 11 moves against an elastic force of the solenoid valve spring 10 to close the piston pressure relief hole 8. The pressure in the piston cylinder 6 is increased, and the piston return spring 5 is reset to close the gas outlet 7, such that the gas flow channel is closed.

When the solenoid valve 11 is powered off, the solenoid valve spring 10 pushes the solenoid valve 11 to move and open the piston pressure relief hole 8. The high-pressure gas in piston cylinder 6 is released from the piston pressure relief hole 8, and the pressure in piston cylinder 6 is reduced. The moving piston 4 moves to open the gas outlet 7, such that the gas flow channel is re-established and the gas starts to be injected.

The working process of the system of the present disclosure is as follows. When the surface drill rig is working normally, the pressure sensor 9 and the sensor chip set 14 acquire and store the pressure, temperature, and well inclination data in the data storage 16. The logic coding controller 17 converts these data into binary downhole data. When the downhole data needs to be transmitted, the surface drill rig is controlled to stop, but the gas circulation is not interrupted. When the angular velocity sensor detects the stop action of the surface drill rig, the pressure sensor 9 records the initial pressure value $P_0$. The logic coding controller 17 controls the solenoid valve 11 to be powered on and close the piston pressure relief hole 8 to increase the pressure in the piston cylinder 6. When the pressure sensor 9 detects that the pressure data reaches the pressure threshold, the solenoid valve 11 is powered off, and the piston pressure relief hole 8 is opened, such that the high-pressure gas in the piston cylinder 6 is released through the piston pressure relief hole 8 to obtain a pressure pulse. The pressure in the piston cylinder 6 is reduced to the initial pressure value $P_0$, ready to output the next pressure pulse until the communication of the downhole data is completed. The logic coding controller 17 adjusts the pressure threshold to a low-pulse pressure value $P_1$ and a high-pulse pressure value $P_2$ according to the binary downhole data to generate a low-pressure pulse and a high-pressure pulse, respectively. A surface pressure sensor records the low- and high-pressure pulses, thereby completing the communication of the downhole data and realizing the communication of the gas drilling pressure pulse while drilling. In the present disclosure, the low-pressure pulse and the high-pressure pulse can also be converted by a computer into "0" and "1" in the binary code, respectively. The binary data is then converted into temperature, pressure, and inclination angle data to realize the restoration of the downhole data and obtain the downhole data.

It should be noted that the above process of converting the pressure pulse wave into binary data and converting the binary data into temperature, pressure, and well inclination data by the computer is well known to those skilled in the art or can be easily obtained by those skilled in the art from the prior art. The present disclosure only claims to protect the above-mentioned pressure pulse communication system.

Figure 5:
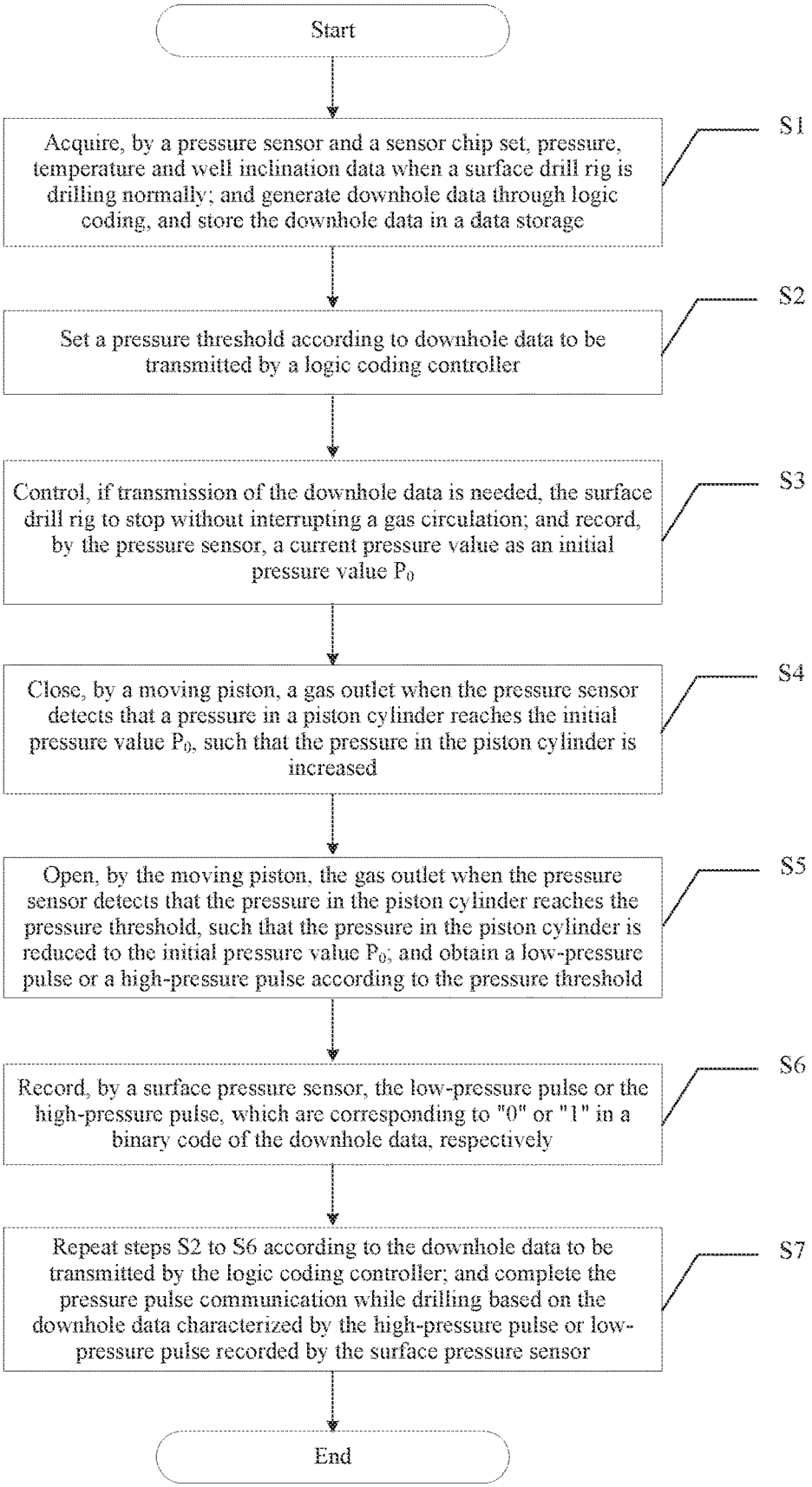
FIG. 5 is a flowchart of a pressure pulse communication method during gas drilling according to the present disclosure.

As shown in FIG. 5, an embodiment of the present disclosure provides a pressure pulse communication method during gas drilling, including the following steps:

S1: Acquire, by a pressure sensor 9 and a sensor chip set 14, pressure, temperature, and well inclination data when a surface drill rig is drilling normally; generate downhole data through logic coding; and store the downhole data in a data storage 16.

S2: Set a pressure threshold according to downhole data to be transmitted by a logic coding controller 17.

S3: if transmission of the downhole data is needed, control the surface drill rig to stop drilling without interrupting a gas circulation; and record, by the pressure sensor 9, a current pressure value as an initial pressure value $P_0$.

S4: Close, by a moving piston 4, a gas outlet 7 to increase the pressure in the piston cylinder 6 when the pressure sensor 9 detects that the pressure in a piston cylinder 6 reaches the initial pressure value $P_0$.

S5: Open, by the moving piston 4, the gas outlet 7 to reduce the pressure in the piston cylinder 6 to the initial pressure value $P_0$ when the pressure sensor 9 detects that the pressure in the piston cylinder 6 reaches the pressure threshold; and obtain a low-pressure pulse or a high-pressure pulse according to the pressure threshold.

S6: Record, by a surface pressure sensor, the low-pressure pulse or the high-pressure pulse, which are corresponding to "0" or "1" in a binary code of the downhole data, respectively.

S7: Repeat steps S2 to S6 according to the downhole data to be transmitted by the logic coding controller 17, and complete the pressure pulse communication while drilling based on the downhole data characterized by the high-pressure pulse or low-pressure pulse recorded by the surface pressure sensor.

In step S1, the step of generating downhole data through logic coding specifically includes:

Generate, by the logic coding controller 17, the binary downhole data through logic coding.

In step S2, the step of setting a pressure threshold specifically includes:

Set the pressure threshold according to the downhole data to be transmitted by the logic coding controller 17, set the pressure threshold to $P_1$ if the data to be transmitted by the logic coding controller 17 is "0" in the binary code, and set the pressure threshold to $P_2$ if the data to be transmitted by the logic coding controller 17 is "1" in the binary code.

Step S4 includes the following sub-steps:

S41: Open; by the logic coding controller 17, a solenoid valve 11 when the pressure sensor 9 detects that the current pressure value reaches the initial pressure value $P_0$, such that the solenoid valve 11 moves against an elastic force of a solenoid valve spring 10 to seal a piston pressure relief hole 8.

S42: Guide a gas injected from a gas inlet 2 to the piston cylinder 6 through a piston micro-hole 3; and move, by the piston return spring 5, the moving piston 4 to close the gas outlet 7 to increase the pressure in the piston cylinder 6.

Step S5 specifically includes:

S51: Close, by the logic coding controller 17, the solenoid valve 11 when the pressure sensor 9 detects that the pressure in the piston cylinder 6 reaches the pressure threshold; and reset the solenoid valve spring 10 to move the solenoid valve 11 to open the piston pressure relief hole 8.

S52: Discharge the gas in the piston cylinder 6 from the piston pressure relief hole 8 to reduce the pressure in the piston cylinder 6, and move the moving piston 4 to open the gas outlet 7, such that the pressure in the piston cylinder 6 is reduced to the initial pressure value $P_0$, and a low-pressure pulse or the high-pressure pulse is obtained.

The low-pressure pulse and the high-pressure pulse are spikes in pressure changes recorded by the surface pressure sensor. The low-pressure pulse undergoes a pressure value change process as follows: $P_0$, $P_1$, and $P_0$. The high-pressure pulse undergoes a pressure value change process as follows: $P_0$, $P_2$, and $P_0$.

When the pressure threshold is a low-pulse pressure value, namely $P_1$, the low-pressure pulse is obtained. When the pressure threshold is a high-pulse pressure value, namely $P_2$, the high-pressure puke is obtained.

The present disclosure has the following beneficial effects. The solenoid valve control system has a simple structure and low cost.

The communication data is not limited by the transmission distance, and a longer transmission distance only requires a longer time to transmit the signal.

Compared with the microwave-based measurement-while-drilling (M-MWD) technology that requires the inside of the drill pipe to be dry and free of foreign matter, the technology of the present disclosure can be used for mist drilling or foam drilling. Compared with mud pulse (MP) telemetry that cannot be used for gas drilling, the technology of the present disclosure can be used for air drilling and even aerated mud drilling.

It should be understood that in the description of the present disclosure, orientations or position relationships indicated by terms, such as "center", "thickness", "upper", "lower", "horizontal", "top", "bottom", "inside", "outside", and "radial," are orientations or position relationships shown in the drawings. These terms are merely intended to facilitate description of the present disclosure and simplify the description, rather than to indicate or imply that the mentioned device or element must have a specific orientation or must be constructed and operated in a specific orientation, and therefore, should not be understood as a limitation to the present disclosure. In addition, the terms such as "first", "second", and "third" are used only for descriptive purposes and should not be construed as indicating or implying relative importance or implying the number of indicated technical features. Thus, features defined by "first", "second", and "third" may explicitly or implicitly include one or more of the features.

What is claimed is:

1. A pressure pulse communication system during gas drilling comprising a downhole solenoid valve module and a sensor module, wherein the downhole solenoid valve module and the sensor module are arranged in a drill pipe of a surface drill rig; the sensor module is connected to a solenoid valve of the downhole solenoid valve module; and the downhole solenoid valve module comprises a valve body, a gas inlet, a piston micro-hole, a moving piston, a piston return spring, a piston cylinder, a gas outlet, a piston pressure relief hole, a solenoid valve spring, the solenoid valve, a battery, a pressure balancer, a rubber seal, a first gas passage, a second gas passage, and a gas passage in the valve body;

the piston return spring has one end fixed to an upper half of an inner wall of the valve body and the other end connected to the moving piston; the piston micro-hole is provided between an upper end surface of the moving piston and an inner wall surface of the valve body; the valve body is further provided therein with the piston cylinder for accommodating the piston return spring and the moving piston; the gas inlet is connected to the piston cylinder through the piston micro-hole; the gas outlet is provided between a side of the moving piston that is not connected to the piston return spring and the inner wall of the valve body; when the piston return spring is in a compressed state, the gas outlet communicates with the gas inlet; and when the piston return spring is in a reset state, the gas outlet and the gas inlet are isolated by the inner wall of the valve body, and the gas outlet communicates with the gas passage in the valve body; and the solenoid valve is provided on a lower half of the inner wall of the valve body; the solenoid valve spring is provided on a top of the solenoid valve; a space in which the solenoid valve spring is provided is connected to the piston cylinder through the first gas passage on the left and is connected to the piston pressure relief hole through the second gas passage on the right; the piston pressure relief hole communicates with the gas passage in the valve body; the battery is provided below the solenoid valve, and is electrically connected to the solenoid valve; the pressure balancer is provided on the inner wall of the valve body below the battery; and the rubber seal is provided at a connection between the valve body and the drill pipe;

wherein the sensor module comprises a pressure sensor, a sensor chip set, a data storage, and a logic coding controller; the pressure sensor is provided on the inner wall of the valve body on two sides of the solenoid valve and is connected in communication with the logic coding controller; the sensor chip set, the data storage, and the logic coding controller are provided on the lower half of the inner wall of the valve body; and the logic coding controller is connected in communication with the sensor chip set and the data storage.

2. A pressure pulse communication method during gas drilling according to the pressure pulse communication system during gas drilling in claim 1, comprising the following steps:

S1: acquiring, by the pressure sensor and the sensor chip set, pressure, temperature, and well inclination data when the surface drill rig is drilling normally; and generating downhole data through logic coding, and storing the downhole data in the data storage;

S2: setting a pressure threshold according to downhole data to be transmitted by the logic coding controller;

S3: when transmission of the downhole data is needed, controlling the surface drill rig to stop drilling without interrupting a gas circulation; and recording, by the pressure sensor, a current pressure value as an initial pressure value $P_0$;

S4: closing, by the moving piston, the gas outlet to increase a pressure in the piston cylinder when the pressure sensor detects that the pressure in the piston cylinder reaches the initial pressure value $P_0$;

S5: opening, by the moving piston, the gas outlet to reduce the pressure in the piston cylinder to the initial pressure value $P_0$ when the pressure sensor detects that the pressure in the piston cylinder reaches the pressure threshold; and obtaining a low-pressure pulse or a high-pressure pulse according to the pressure threshold;

S6: recording, by a surface pressure sensor, the low-pressure pulse or the high-pressure pulse, which are corresponding to "0" or "1" in a binary code of the downhole data, respectively; and S7: repeating steps S2 to S6 according to the downhole data to be transmitted by the logic coding controller, and completing pressure pulse communication while drilling based on the downhole data characterized by the high-pressure pulse or the low-pressure pulse recorded by the surface pressure sensor.

3. The pressure pulse communication method during gas drilling according to claim 2, wherein in step S1, the generating the downhole data through logic coding specifically comprises:

generating, by the logic coding controller, the binary downhole data through logic coding.

4. The pressure pulse communication method during gas drilling according to claim 2, wherein in step S2, the setting the pressure threshold comprises:

setting the pressure threshold according to the downhole data to be transmitted by the logic coding controller; setting the pressure threshold to $P_1$ when the data to be transmitted by the logic coding controller is "0" in the binary code; and setting the pressure threshold to $P_2$ when the data to be transmitted by the logic coding controller is "1" in the binary code.

5. The pressure pulse communication method during gas drilling according to claim 4, wherein step S5 specifically comprises:

S51: closing, by the logic coding controller, the solenoid valve when the pressure sensor detects that the pressure in the piston cylinder reaches the pressure threshold; and resetting the solenoid valve spring to move the solenoid valve for opening the piston pressure relief hole; and S52: discharging the gas in the piston cylinder from the piston pressure relief hole to reduce the pressure in the piston cylinder, moving the moving piston to open the gas outlet for reducing the pressure in the piston cylinder to the initial pressure value $P_0$, and obtaining the low-pressure pulse or the high-pressure pulse, wherein:

when the pressure threshold is a low-pulse pressure value, $P_1$, the low-pressure pulse is obtained; and when the pressure threshold is a high-pulse pressure value, $P_2$, the high-pressure pulse is obtained.

6. The pressure pulse communication method during gas drilling according to claim 2, wherein step S4 comprises:

S41: opening, by the logic coding controller, the solenoid valve when the pressure sensor detects that the current pressure value reaches the initial pressure value $P_0$, such that the solenoid valve moves against an elastic force of the solenoid valve spring to seal the piston pressure relief hole; and S42: guiding a gas injected from the gas inlet to the piston cylinder through the piston micro-hole; and moving, by the piston return spring, the moving piston to close the gas outlet to increase the pressure in the piston cylinder.

* * * * *